United States Patent [19]

Gaucher et al.

[11] 4,006,043

[45] Feb. 1, 1977

[54] METHOD OF MAINTAINING AT VERY LOW VALUES THE CONTENT OF CYANIDE IN SALT BATHS CONTAINING CYANATES

[75] Inventors: Antoine Gaucher, Saint-Etienne; Gérard Guilhot, St-Jean Bonnefonds, both of France

[73] Assignee: Centre Stephanois de Recherches Mecaniques Hydromecanique et Frottement, Andrezieux-Boutheon, France

[22] Filed: May 13, 1975

[21] Appl. No.: 576,993

[30] Foreign Application Priority Data

May 17, 1974 France ..... 74.17195
Apr. 10, 1975 France ..... 75.11166

[52] U.S. Cl. ..... 148/27; 148/15.5; 148/18

[51] Int. Cl.[2] ..... B23K 35/24

[58] Field of Search ..... 148/27, 28, 16.5, 16.6, 148/15.5, 15, 6.11, 18, 20

[56] References Cited

UNITED STATES PATENTS

| | | | |
|---|---|---|---|
| 2,562,065 | 7/1951 | Sawyer | 148/27 |
| 2,801,154 | 7/1957 | De Pree et al. | 148/27 |
| 2,875,095 | 2/1959 | Muller | 148/19 |
| 3,022,204 | 2/1962 | Muller et al. | 148/27 |
| 3,303,063 | 2/1967 | Pietryka | 148/15.5 |
| 3,475,291 | 10/1969 | Caubet | 148/16.6 |

*Primary Examiner*—Walter R. Satterfield
*Attorney, Agent, or Firm*—Young & Thompson

[57] ABSTRACT

The invention relates to a method of maintaining at very low values the proportions of cyanides in molten-salt baths of the kind in which the main active principle is the cyanate anion $CNO^-$, the method comprising essentially the steps of conjointly providing in the salt bath at least one sulphurized element in a quantity such that the proportion of the sulphur element in the bath is between 0.001 and 0.1 % of the weight of said bath, and introducing periodically or continuously into the bath at least one substance comprising at least one carbonyl group = C = O in its chemical formula, in a quantity such that it corresponds to a weight of between 1 and 25 grams of CO per kg. of bath and per 24 hours maintenance at the bath working temperature of between 480° and 650° C. The substance introducing the carbonyl group may also constitute a regenerating agent for the cyanate anion and can advantageously be obtained by baking carbamide for 3 to 10 hours at a temperature of between 150° and 450° C. The bath may be homogenized by agitation means including insufflation of air.

The invention is especially applicable to the nitridation of mechanical parts in heat-treatment salt-baths.

8 Claims, No Drawings

METHOD OF MAINTAINING AT VERY LOW VALUES THE CONTENT OF CYANIDE IN SALT BATHS CONTAINING CYANATES

Treatments in molten-salt baths are already known, in which the active principle is mainly the cyanate anion $CNO^-$, which especially introduce nitrogen into the surface layers of mechanical parts, especially of ferrous metals. These treatments are mainly directed to improving resistance to seizure, to wear, to corrosion and to fatigue of the parts. The corresponding baths may be obtained by using products free from cyanide. In this case, they are non-polluting, at least at the beginning.

These treatments have however a disadvantage, which is the spontaneous appearance of cyanide as a result of a decomposition of the cyanates, following a reaction of the type:

$$4\ CNO^- \rightarrow CO_3^{--} + 2N + 2CN^- \quad (1)$$

The main problem presented by these baths is thus to prevent the appearance of cyanide, in order that they may remain non-polluting.

It is known that baths comprising on the one hand $CO_3^{--}$ and $CNO^-$ anions, and on the other hand alkaline cations such as lithium and/or alkaline-earth cations, retard the appearance of cyanides by delaying the reaction (1) referred to above.

It is also known that by means of blowing air into the bath, it is possible partially to oxidize the cyanides appearing there as and when they form, by a reaction of the type:

$$CN^- + \tfrac{1}{2}\ O_2 \rightarrow CNO^- \quad (2)$$

Finally, it is known that the cyanides can be oxidized to cyanates by carbon dioxide, following a reaction of the type:

$$CN^- + CO_2 \rightarrow CNO^- + CO \quad (3)$$

and that by blowing $CO_2$ into the bath it is possible partially to oxidize the cyanides.

However, these methods have disadvantages, of which the main one is that they do not result in a complete elimination of the cyanides.

The present invention proposes a method free from these drawbacks, which makes it possible to obtain, within the range of temperature comprised between 480° and 650° C., molten-salt baths in which the active principle is the cyanate anion $CNO^-$ and in which the cyanide content is nil or at least has extremely low value, unequalled at the present time, in all cases less than 0.5 to 1 %.

This invention is based on observations and discoveries made by the Applicant, as follows:

Reactions such as those of the type (2) or (3) are all the more complete and their speed is all the greater when the oxygen which takes part in the reaction (2) and the $CO_2$ which takes part in the reaction (3) are not respectively supplied from the exterior but are directly nascent in the heart of the bath;

the oxidation of the cyanides is all the greater when the two reactions (2) and (3) take place simultaneously;

the presence in the bath of small quantities of a sulphurized product facilities the oxidation of the cyanides to cyanates by catalytic action; more precisely, this effect is remarkable when the content by weight of the sulphur element in the bath is comprised between 0.001 and 0.1 % of the weight of the said bath; the sulphurized product or products resulting in this effect belong to the group formed by sulphur and sulphides, sulphites, hyposulphites, alkali and alkaline-earth thiosulphates;

finally, it is possible to obtain the liberation of the oxygen and $CO_2$ nascent in situ in the bath by introducing into the centre of this latter a substance having oxygen in its chemical formula, and more precisely at least a carbonyl group, that is to say having the form $>C=O$, or alternatively the form $=C=O$, this effect is particularly remarkable when there is introduced into the bath a quantity of the said substance such that per kg. of bath and per 24 hours maintenance of temperature, it corresponds to a weight of CO in the carbonyl form, comprised between 1 and 25 grams per kg. of bath.

The foregoing effect are of course increasingly important as the composition of the bath is homogeneous, this homogeneity being obtained by any desired means, the most simple being to agitate the bath by blowing air, this technique furthermore facilitating the catalytic action of the sulphur on the conversion of the cyanides to cyanates.

Finally, the method according to the invention consists simultaneously;

on the one hand of introducing sulphur into the bath and maintaining its content at between 0.001 and 0.1 % of the weight of the bath;

on the other hand of injecting periodically or continuously into the bath, the range of temperature utilization of which is comprised between 480° and 650° C., a substance having in its chemical formula at least one carbonyl group in a quantity such that, per kg. of bath and per 24 hours of maintenance at temperature, it corresponds to a weight of CO of between 1 and 25 grams.

In this way, there are obtained baths whose active principle is mainly the cyanate anion $CNO^-$, in which the content of cyanide reaches and retains in time very low values, unequalled up to the present time.

The substance including in its formula a carbonyl group is advantageously added at the same time as a known regenerating agent for the cyanate anion. This enables the recharging operations of the bath to be reduced.

It is especially advantageous that the substance comprising a carbonyl group in its formula should also constitute a regenerating agent for the cyanate anion, with one or more amine or amide groups for example.

By way of non-limitative example, it is particularly advantageous to use a mixture of substances obtained by baking carbamide, also known as urea, at a temperature of 150° to 450° C. for a period of 3 to 10 hours.

The sulphurized products present in the bath, which are preferably selected from the group consisting of: sulphur and sulphides, sulphites, hyposulphites, sulphates, alkali and alkaline-earth thiosulphates, are defined so as to increase the effectiveness of the function of sulphur in the bath.

The function of the sulphur or sulphurized products in baths having a base of cyanates and alkaline carbonates is threefold:

On the one hand, it creates iron sulphide at the surface of parts of ferrous alloys which subsequently plays the part, in course of friction, of a weld inhibitor, that is to say it prevents seizure;

on the other hand, it increases the kinetics of formation of the nitrided combination micro-layer;

and finally it oxidizes the traces of cyanides to cyanates.

Now, the Applicants have discovered:

In the first place, that the first two of the three functions of the sulphur referred to above were increasingly marked when the sulphur was present in the bath in the form of sulphide $S^{--}$, that is to say at the lowest degree of oxidation;

in the second place, that the third of the functions of the sulphur is increasingly marked when the sulphur is present in the bath in an oxidized form of the sulphite, thiosulphate, sulphate, hyposulphite type, that is to say at degrees of oxidation greater than O. For example, sulphate $SO_4^{--}$ behaves like an oxidizing agent with respect to cyanides, following a reaction of the type:

$$SO_4^{2-} + 4\,CN^- \rightarrow 4\,CNO^- + S^{--}$$

The same thing is true with the other oxidized product of sulphur. For example, with the product $SO_3^{--}$, there is obtained a reaction of the type:

$$SO^{--} + 3CN^- \rightarrow CNO^- + S^{--}$$

In consequence, the sulphur is present simultaneously at the degree of oxidation minus 2 and at a degree of oxidation higher than zero.

This may be effected in different ways. For example, there may be introduced into the bath a mixture of products of which some supply the sulphur in the form $S^{--}$, while the others supply it in an oxidized form, for example a mixture of sulphide and sulphite or alternatively a mixture of sulphide and sulphates, etc.. However, it is also possible more simply to carry out in the bath the oxidation of the form $S^{--}$ of the sulphur, for example by direct action of oxygen, the most convenient method being to blow air into the heart of the bath.

The following examples are given in a non-restrictive sense:

EXAMPLE 1

The starting bath has the following initial composition by weight:

| | |
|---|---|
| $CO_3^{2-}$ | 25 % |
| $CNO^-$ | 35 % |
| $Na^+$ | 20 % |
| $K^+$ | 20 % |

After 24 hours heating at 565° ± 5° C., it is found that the composition of the bath becomes:

| | |
|---|---|
| $CO_3^{2-}$ | 29 % |
| $CNO^-$ | 25 % |
| $CN^-$ | 6 % |
| $Na^+$ | 20 % |
| $K^+$ | 20 % |

In other words, if there was an appearance of cyanide in the bath, and if the bath were permitted to develop, the cyanides it contains would continue to increase.

If on the other hand, according to the invention, there are added to the bath, by weight:

0.03 % of $K_2S$ 0.5 % of biuret having the formula:

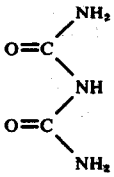

it is found that the composition of the bath changes into that given below after 24 hours heating at 565° ± 5° C.:

| | |
|---|---|
| $CO_3^{2-}$ | 25.2 % |
| $CNO^-$ | 34.8 % |
| $CN^-$ | 0.08 % |
| $Na^+$ | 20 % |
| $K^+$ | 20 % |

The composition of the bath is maintained practically constant. The content of cyanides in the bath is almost nil. Furthermore, it retains this extremely low value after prolonged maintenance at temperature, on the condition of course, according to the invention, on the one hand that the said content of $K_2S$ is maintained in the bath, and on the other hand that there is added, for example continuously, into the bath a quantity of biuret equal for example to 0.5 % by weight of the bath per 24 hours maintenance at the working temperature.

In this example, the content of sulphur element in the bath is equal to 0.01% of the weight of the bath, which means that it is clearly comprised between 0.001 and 0.1 % of the weight of the said bath. There is added to the bath, per 24 hours maintenance at working temperature, a quantity of biuret equal to 0.5 % of the weight of the bath, which corresponds to 2.6 grams of CO per kg. of bath, which quantity is truly comprised between 1 and 25 grams in accordance with the invention.

EXAMPLE 2

The same bath is again employed as that previously described.

According to the invention, there are added to the bath, by weight:

0.01 % of $K_2S$ 0.3 % of salt obtained by baking the carbamide for 10 hours at 240° C.

It is found that the composition of the bath has changed to that specified below after 24 hours heating at 565° ± 5° C.:

| | |
|---|---|
| $CO_3^{2-}$ | 25.1 % |
| $CNO^-$ | 34.85 % |
| $CN^-$ | 0.05 % |
| $Na^+$ | 20 % |
| $K^+$ | 20 % |

The composition of the bath was maintained practically constant. In particular, the cyanides were stabilized at an extremely-low value, on the condition, of course, according to the invention, of adding per cycle of 24 hours, either continuously or discontinuously, the quantities of salts necessary for regeneration, that is to say ensuring the conversion of the inactive carbonate type to the active cyanate type, and maintaining the content of sulphurized type constant in the bath.

In this example according to the invention, the quantity of sulphur is actually comprised between 0.001 and 0.1 % by weight of the bath.

There is added to the bath, per 24 hours of maintenance at working temperature, a quantity of salt equal to 0.3 % of the weight of the bath. This salt constitutes the regenerating agent of the inactive carbonate element to an active cyanate element. It is mainly composed of a base of biuret having the formula:

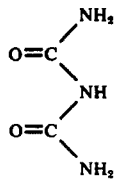

and of ammeline, having the formula:

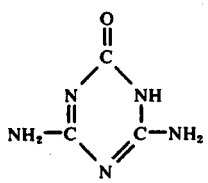

The carbonyl group $O=C<$ according to the invention is again clearly found.

The corresponding quantities of $O=C<$ added per kg. of bath per 24 hours maintenance at a temperature of 565° ± 5° C are substantially equal to 1.5 grams, which is clearly comprised between 1 and 25 grams according to the invention.

EXAMPLE 3

A bath of alkaline carbonates and cyanates is prepared having the following composition by weight:

| | |
|---|---|
| $CNO^-$ | 35 % |
| $CO_3^{2-}$ | 20 % |
| $Li^+$ | 1.2 % |
| $Na^+$ | 18.3 % |
| $K^+$ | 24 % |
| $S^{2-}$ | 0.02 % |
| $SO_4^{2-}$ | 0.05 % |

After 24 hours heating at 570° C., the composition has become modified as follows:

| | |
|---|---|
| $CNO^-$ | 34.8 % |
| $CO_3^{2-}$ | 20.2 % |
| $Li^+$ | 1.2 % |
| $Na^+$ | 18.3 % |
| $K^+$ | 24 % |
| $S^{2-}$ | 0.01 % |
| $SO_4^{2-}$ | 0.04 % |
| $CN^-$ | 0.04 % |

A bath of this kind is remarkably stable, this being due to the presence of an oxidized form of sulphur (in this case $SO_4^{--}$) which prevented the formation of cyanides.

On the other hand, if the oxidized form of sulphur $SO_4^{--}$ had not been introduced into the bath, then all other things being equal, the content of cyanide in the bath would have been almost 1 % after 24 hours heating.

EXAMPLE 4

The bath previously described is again utilized, but without any oxidized sulphur product. Air is blown into this bath at the rate of 0.5 liter per hour per kg. of bath. After 24 hours heating at 570° C., the composition is as follows:

| | |
|---|---|
| $CNO^-$ | 34.85 % |
| $CO_3^{2-}$ | 20.14 % |
| $Li^+$ | 1.2 % |
| $Na^+$ | 18.3 % |
| $K^+$ | 24 % |
| $S^{2-}$ | 0.01 % |
| $SO_4^{2-}$ | 0.05 % |
| $CN^-$ | 0.05 & |

There can be appreciated from this example the extremely low value of the cyanide content, due to the fact that the sulphur in the form sulphide has become oxidized to sulphate $SO_4^{2-}$ by the effect of the oxygen in the inblown air.

What we claim is:

1. A method of maintaining at very low values the cyanide content in baths of molten salts in which the main active principle is the cyanate anion $CNO^-$, comprising conjointly providing in said bath sulphur in an amount between 0.001 and 0.1% by weight of said bath, introducing a substance containing at least one carbonyl group into said bath and maintaining said substance in said bath in a quantity such that, per kg. of bath and per 24 hours maintenance at working temperature, said substance has a weight of CO of between 1 and 25 grams, and maintaining the working temperature of said bath between 480° and 650° C.

2. A method as claimed in claim 1, and introducing said sulphur into the bath in the form of a member selected from the group consisting of sulphur, sulphides, sulphites, hyposulphites, sulphates, and alkali and alkaline-earth thiosulphates.

3. A method as claimed in claim 1, and agitating said bath by an insufflation of air.

4. A method as claimed in claim 1, in which said carbonyl group is introduced in the form of a member selected from the group consisting of biuret and ammeline.

5. A method as claimed in claim 1, in which said substance comprising at least one carbonyl group is introduced at intervals into said bath.

6. A method as claimed in claim 1, in which said element comprising at least one carbonyl group in its chemical formula is continuously introduced into said bath.

7. A method as claimed in claim 1, in which said substance comprising at least one carbonyl group in its chemical formula also constitutes a regenerating agent for said cyanate anion.

8. A method as claimed in claim 1, in which said substance comprising at least one carbonyl group in its chemical formula also constitutes a regenerating agent for said cyanate anion and is obtained by maintaining urea, at a temperature of between 150° and 450° C. for a period of 3 to 10 hours.

* * * * *